US005704095A

United States Patent [19]

Guenschel

[11] Patent Number: 5,704,095

[45] Date of Patent: Jan. 6, 1998

[54] HINGE AND SUPPORT

[76] Inventor: Helmut Guenschel, 21 Sparrow Hill Ct., Baltimore, Md. 21228

[21] Appl. No.: 486,518

[22] Filed: Jun. 7, 1995

[51] Int. Cl.[6] ..... E05D 3/06

[52] U.S. Cl. ..... 16/370; 16/366; 16/374; 16/387; 16/DIG. 29

[58] Field of Search ..... 16/366, 370, 371, 16/374, 387, DIG. 29

[56] References Cited

U.S. PATENT DOCUMENTS

| | | | |
|---|---|---|---|
| 1,412,107 | 4/1922 | Evans, Jr. | 16/370 |
| 1,817,773 | 8/1931 | Sipe | 16/370 |
| 2,008,256 | 7/1935 | Lefevre | 16/164 |
| 2,062,840 | 12/1936 | Soss | 16/164 |
| 2,355,542 | 8/1944 | Loftin | 16/371 |
| 2,674,761 | 4/1954 | Weiss | 16/374 |
| 2,771,042 | 11/1956 | Deaton | 109/64 |
| 3,523,323 | 8/1970 | Jorgensen | 16/374 |
| 4,135,273 | 1/1979 | Holmes | 16/169 |
| 4,157,599 | 6/1979 | Holmes | 16/163 |
| 4,848,244 | 7/1989 | Bennett | 108/38 |
| 5,497,534 | 3/1996 | Caruso | 16/288 |

FOREIGN PATENT DOCUMENTS 435662 9/1935 United Kingdom .

*Primary Examiner*—Daniel W. Howell
*Assistant Examiner*—Christopher Kirkman
*Attorney, Agent, or Firm*—Leonard Bloom

[57] ABSTRACT

A hinge for supporting a heavy door on a support. The hinge has a main block mounted on the support and a pair of parallel plates mounted on the door. An extender link and a rotation control link are each pivotally mounted to the main block and between the parallel plates. When the door is in the fully closed position, the main block supports the upper parallel plate. When the door is in the fully opened position, the extender link is interlocked with the rotation control link and supports the door. A compressible seal is formed between the door and the support by a sealant disposed about the perimeter of the door. The compressible seal is not exposed to shear forces.

19 Claims, 12 Drawing Sheets

HINGE AND SUPPORT

The present invention relates to a hinge for a door or panel, and more particularly to a hinge to support a heavy door or panel and to form a seal between the door or panel and a structure.

BACKGROUND ART

A heavy door or panel such as the thick glass door found on exhibits in a museum requires a hinge which provides support for the door or panel as it is moved between an opened and a closed position. Also, at the end of a row of display cabinets, such as where there is a perpendicular wall, a standard hinge does not permit the door or panel to the cabinet to be opened for complete access to the cabinet and the exhibit within the cabinet because the edge of the door will swing into the space beyond the pivot point of the door and will contact the wall before the door is fully opened.

U.S. Pat. No. 1,412,107 to Evans, Jr. discloses a garage door hinge having arms equidistant from the center and side edge of the door. U.S. Pat. No. 1,817,773 to Sipe discloses a concealed door hinge having a dual pair of pivots with connecting links. During the opening of the door, the hinged side travels behind the face line of the mounting surface on the cabinet. Lefevre, in U.S. Pat. No. 2,008,256 discloses a concealed door hinge for an automobile which does not permit the hinge to be mounted between the door and the structure. One part of the hinge is mounted on the edge of the door and the other part is mounted on the door jamb which must be adjacent to the edge of the door in the closed position. The links are relatively lightweight and direct the throwout or offset of the door while not carrying a substantial part of the load. U.S. Pat. No. 2,771,042 to Deaton discloses a hinge for bank vault doors in which the main hinge plate carries the entire weight of the door and the link stabilizes the door. The door moves between the closed and opened positions by maintaining the door parallel to the closed position without rotation of the door. U.S. Pat. No. 4,135,273 to Holmes discloses a hinge with interfitting locking means in which the door rotates about a single pivot point. U.S. Pat. No. 4,848,244 to Bennett discloses a pair of fold-away hinges to support a horizontal work surface which can be folded down when not in use. A slot is provided in which one of the pivots slides during raising and lowering of the work surface. None of these patents disclose a hinge which seals a door to a structure.

SUMMARY OF THE INVENTION

It is an object of the present invention to provide a hinge which supports the weight of a heavy door or panel in the opened and the closed position.

It is a further object of the present invention to provide a hinge which seals a door or panel to a structure without shear to the sealant means.

It is yet another object of the present invention to provide a hinge which permits pivotal movement of the door or panel in a manner wherein the edge of the door or panel remains in front of the face line of the supporting means and the hinge is effective for doors or panels abutting a perpendicular wall.

In accordance with the teachings of the present invention there is disclosed a hinge for supporting a heavy door or panel on a support means including a main block mounted on the support means. The main block has a front, a back, an upper wall and an opposite lower wall. An extender link has a first end pivotally connected between the upper wall and the lower wall of the main block and a second end extending outwardly from the main block. A rotation control link has a first end pivotally connected between the upper wall and the lower wall of the main block and a second end extending outwardly from the main block. An upper plate and a lower plate are mounted parallel to one another on the door or panel. Each parallel plate has a first end near an edge of the door or panel. The respective second ends of each link are pivotally connected to the respective first ends of the parallel plates. When the door or panel is pivotally moved to a closed position substantially parallel and adjacent to the support means, the main block is received beneath the upper plate, thereby substantially supporting the door or panel. When the door or panel is pivotally moved to a fully open position, the door or panel and the parallel plates mounted thereon are approximately perpendicular to the support means, the door or panel being substantially supported by the interlocked extender link and the rotation control link. During the pivoted movement of the door or panel, the edge of the door remains in front of a face line of the supporting means.

In further accordance with the teachings of the present invention there is disclosed a hinge for sealing a door or panel to a structure including a main block mounted on the structure. The main block has a front, a back, an upper wall and an opposite lower wall. An extender link is pivotally connected to the main block. A rotation control link pivotally is connected to the main block adjacent to the extender link. An upper flange means and a lower flange means are mounted on the door or panel. The extender link and the rotation control link are pivotally connected between the upper and lower flange means. Compressible sealant means are connected to the structure. When the panel or door is pivotally moved to a closed position substantially parallel and adjacent to the structure, the main block is received beneath the upper flange means on the door or panel substantially supporting the door or panel. The door or panel contacts the compressible sealant means thereby forming a seal between the door or panel and the structure. When the door or panel is pivotally moved to a fully opened position, the extender link and the rotation control link are interlocked and substantially support the door or panel. The door or panel is rotated away from the support and the seal is opened between the door or panel and the sealant means such that sealant means is compressed and decompressed without shear.

These and other objects of the present invention will become apparent from a reading of the following specification, taken in conjunction with the enclosed drawings.

DESCRIPTION OF THE PREFERRED EMBODIMENTS

Figure 1:
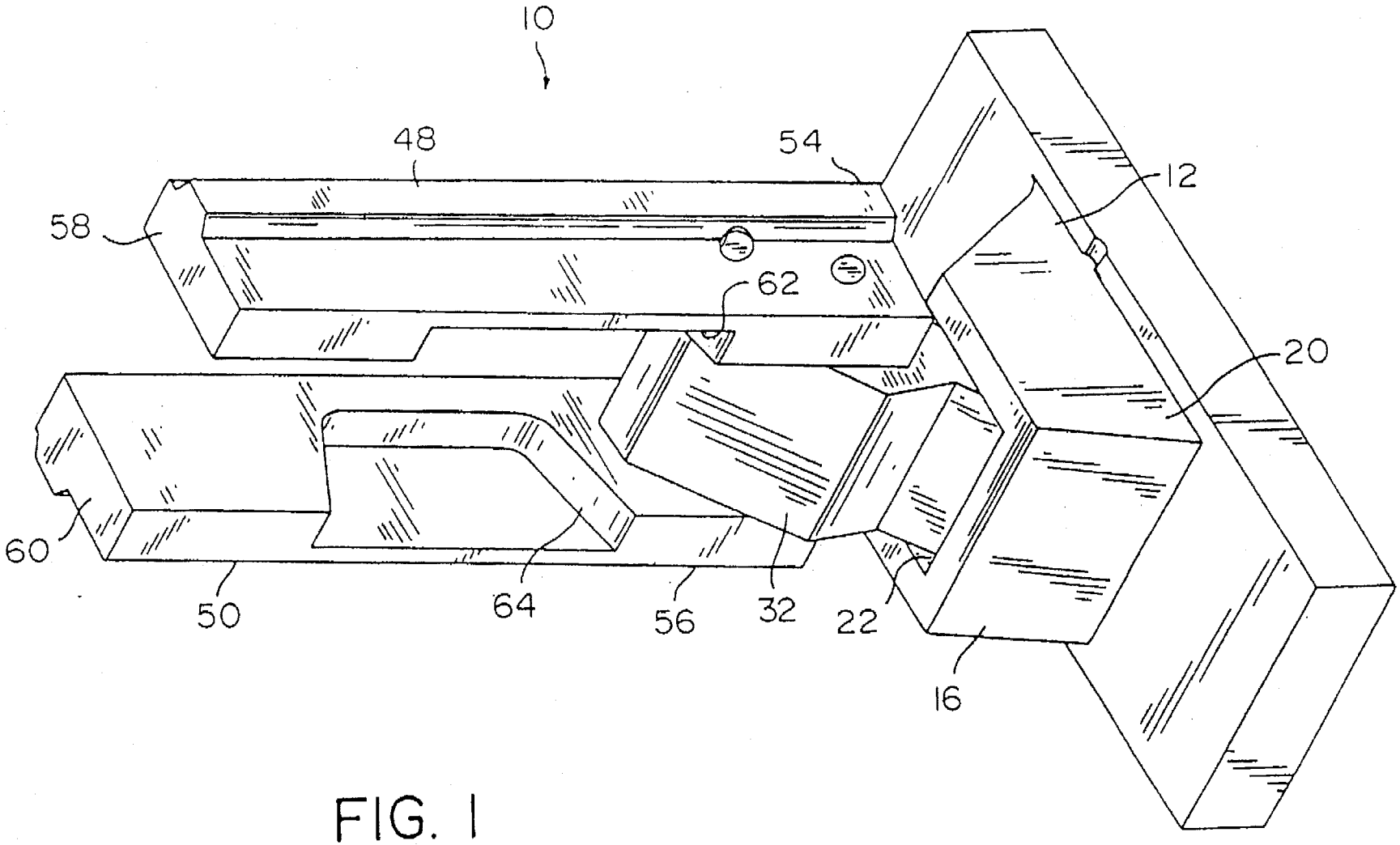
FIG. 1 is a perspective view of the hinge of the present invention with the hinge in a fully opened position.
Figure 2:
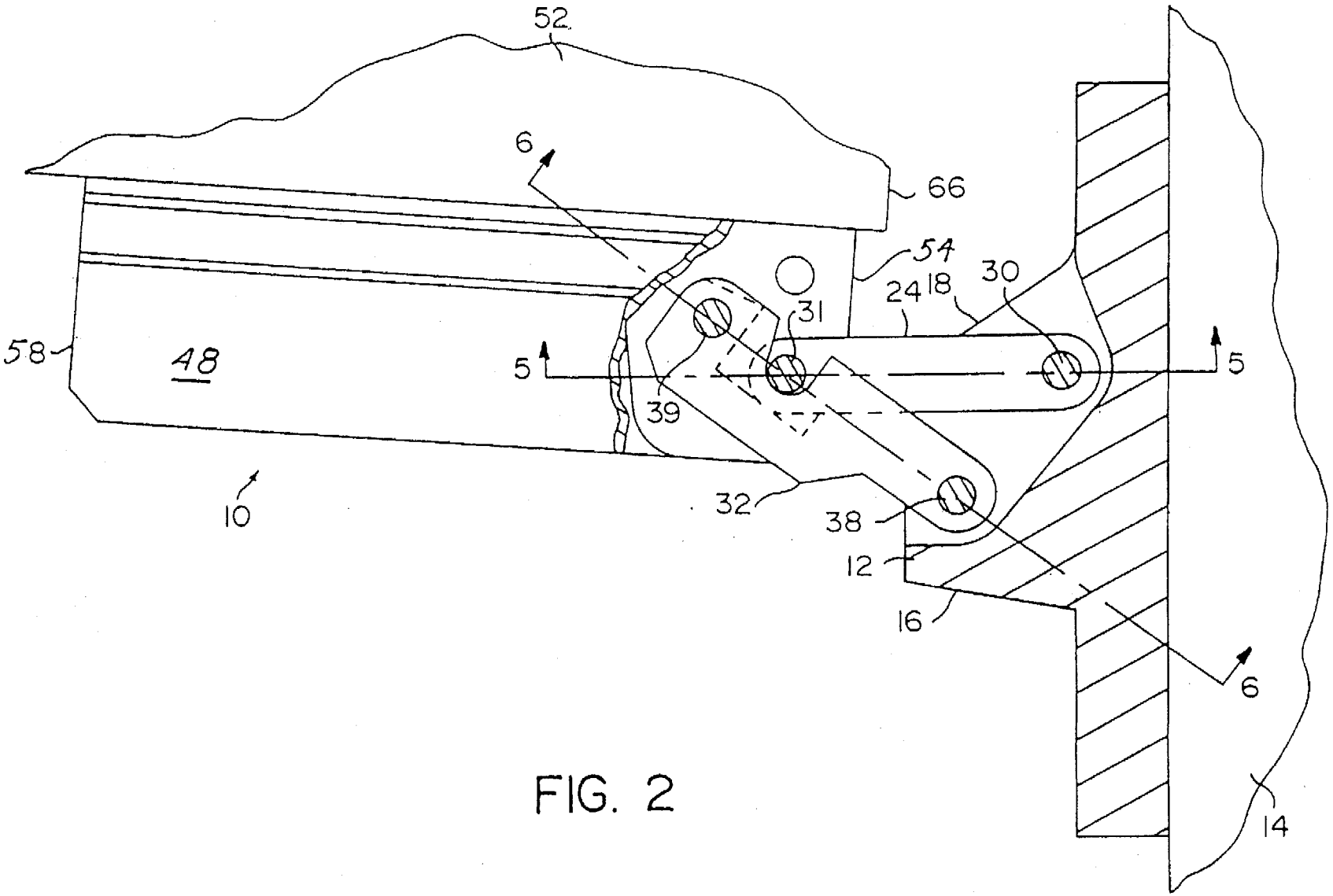
FIG. 2 is a top plan view of the hinge of the present invention with the hinge in the fully open opened position.
Figure 3:
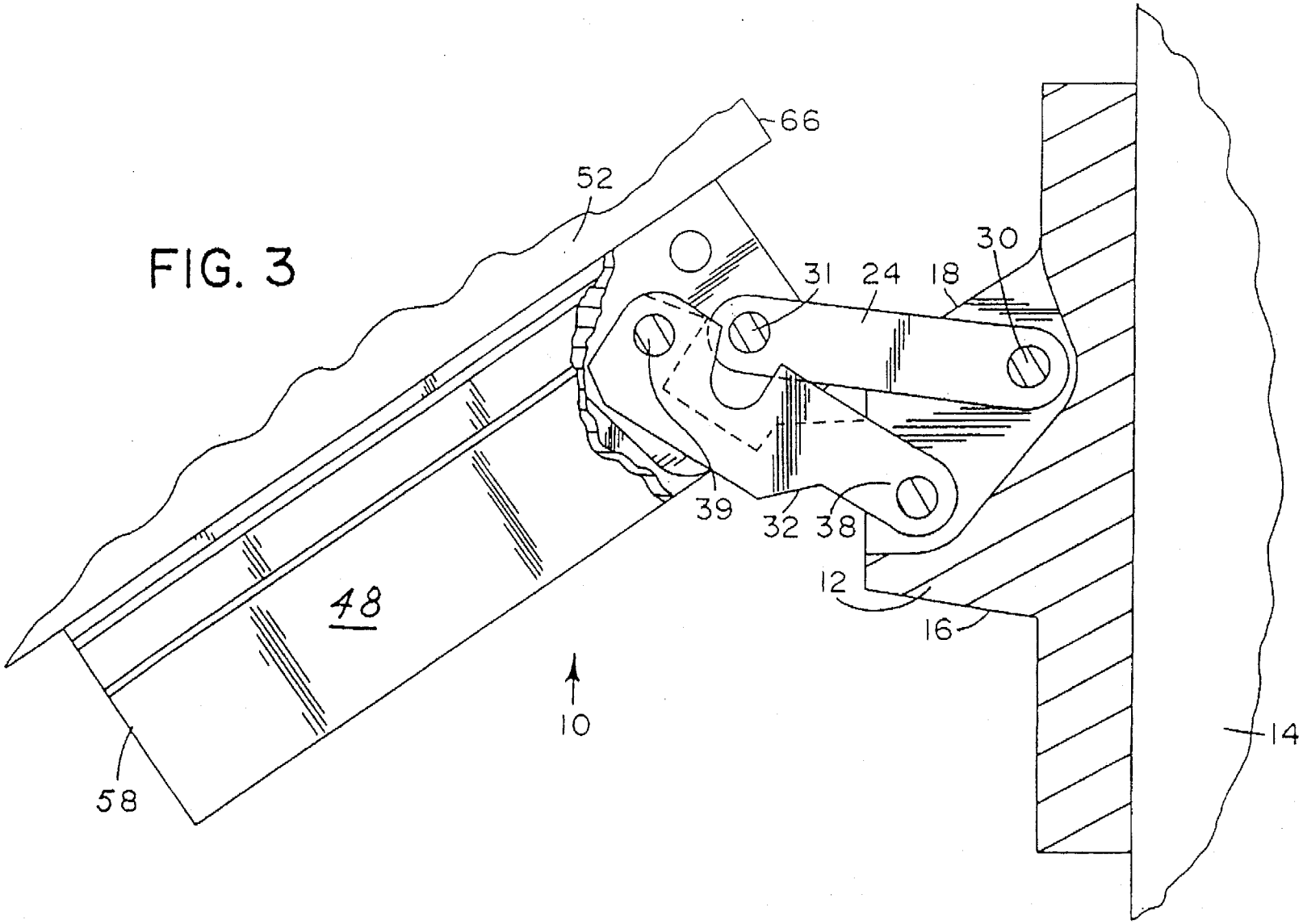
FIG. 3 is a top plan view of the hinge of the present invention in a partially opened position.
Figure 4:
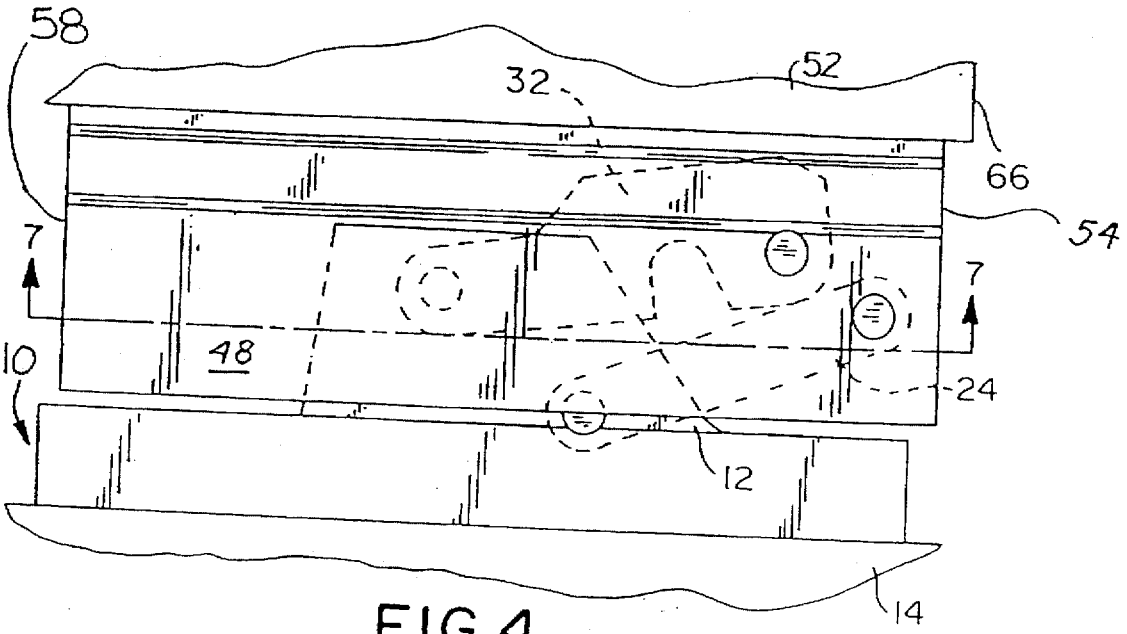
FIG. 4 is a top plan view of the hinge of the present invention in a fully closed position.
Figure 5:
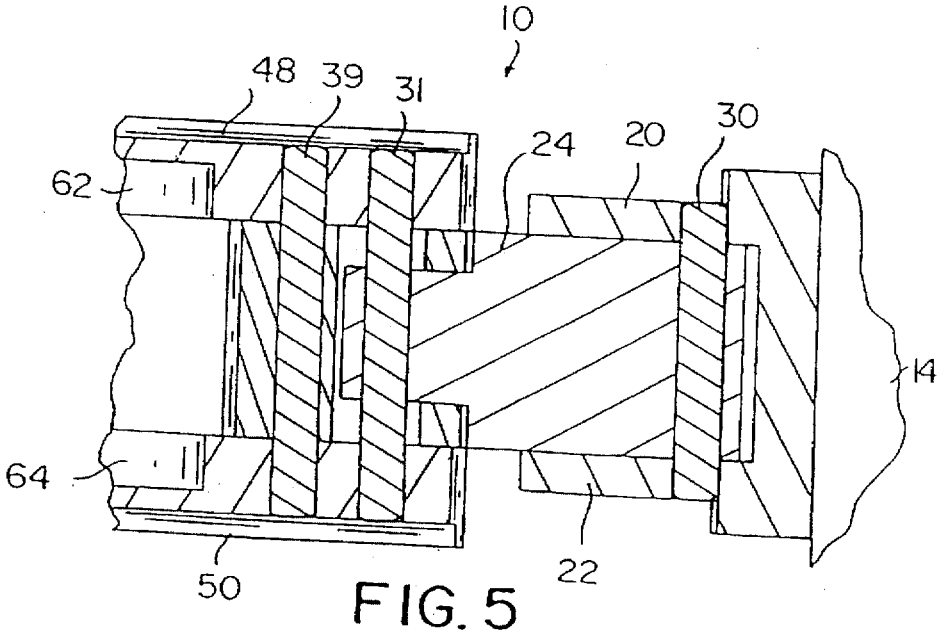
FIG. 5 is a cross-sectional view taken across the lines 5—5 of FIG. 2.
Figure 6:
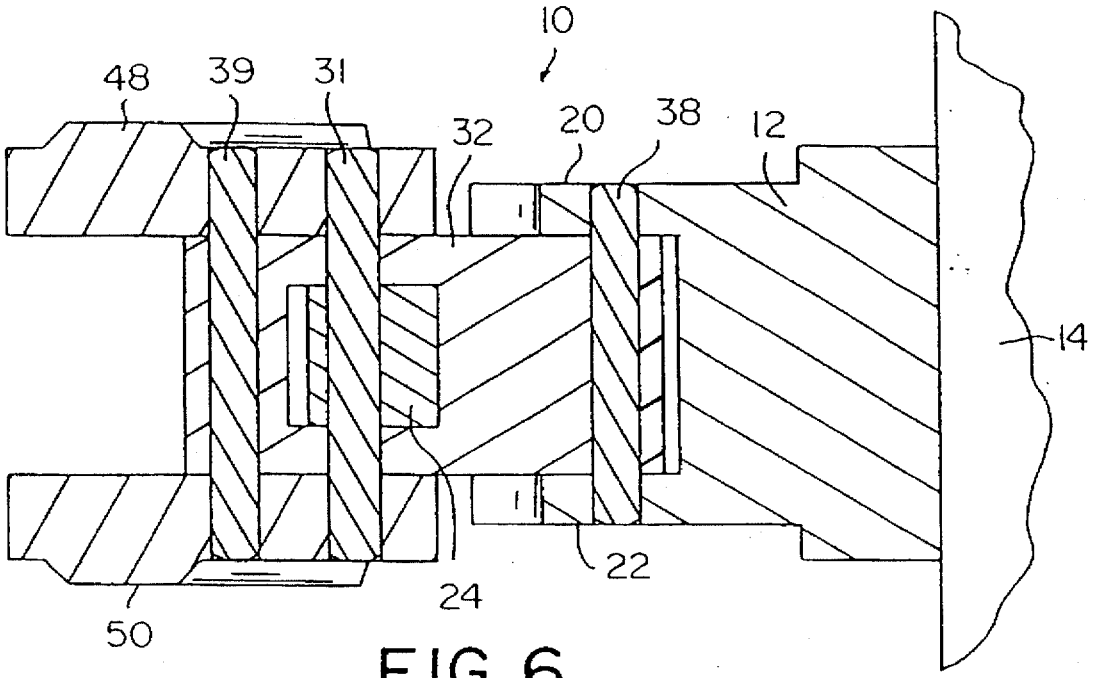
FIG. 6 is a cross-sectional view taken across the lines 6—6 of FIG. 2.
Figure 7:
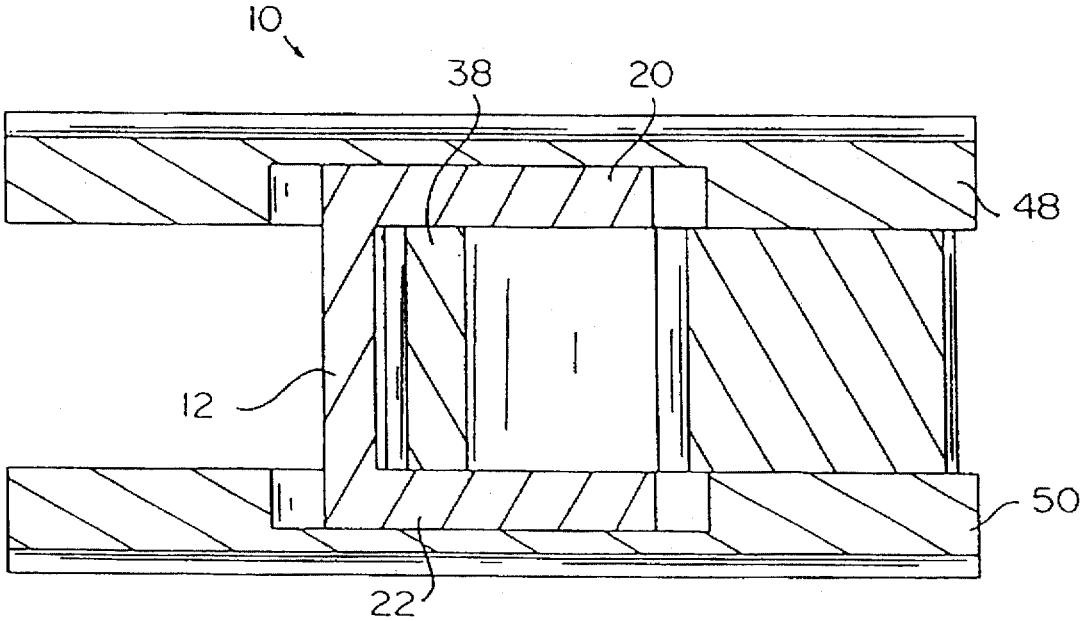
FIG. 7 is a cross-sectional view taken across the lines 7—7 of FIG. 4.
Figure 8:
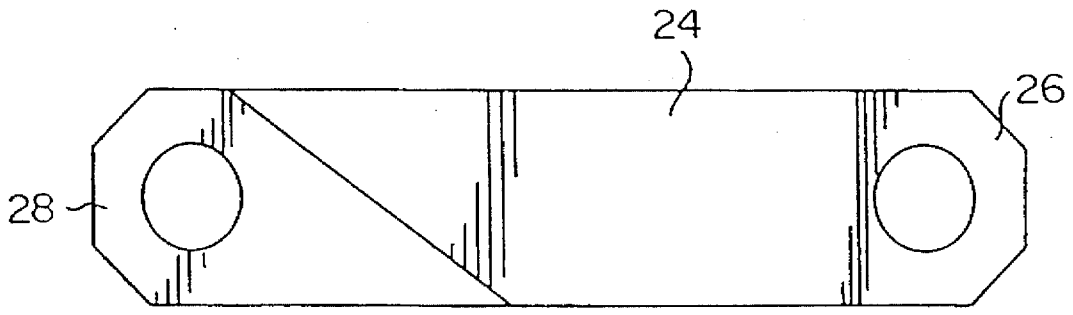
FIG. 8 is a top plan view of the extender link.
Figure 9:
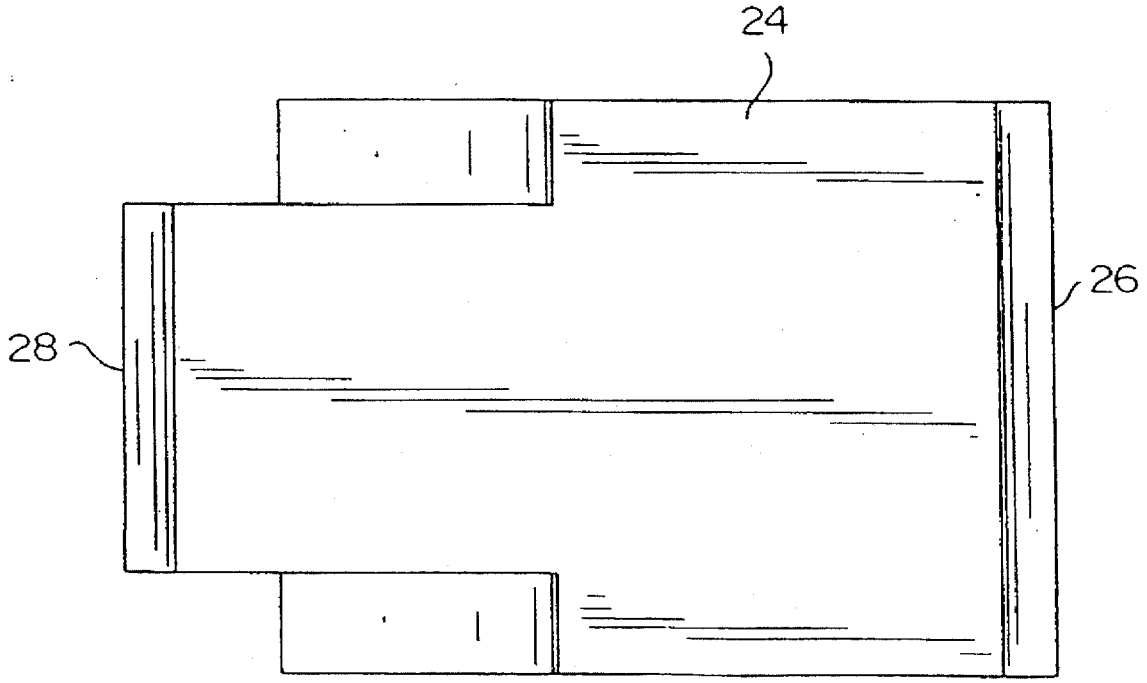
FIG. 9 is a side elevational view of the extender link.
Figure 10:
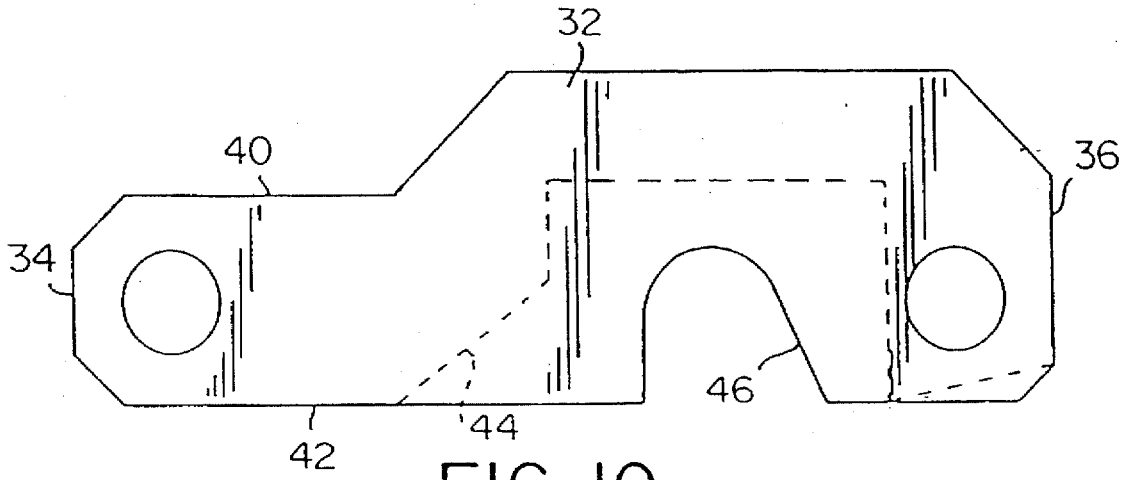
FIG. 10 is a top plan view of the rotation control link.
Figure 11:
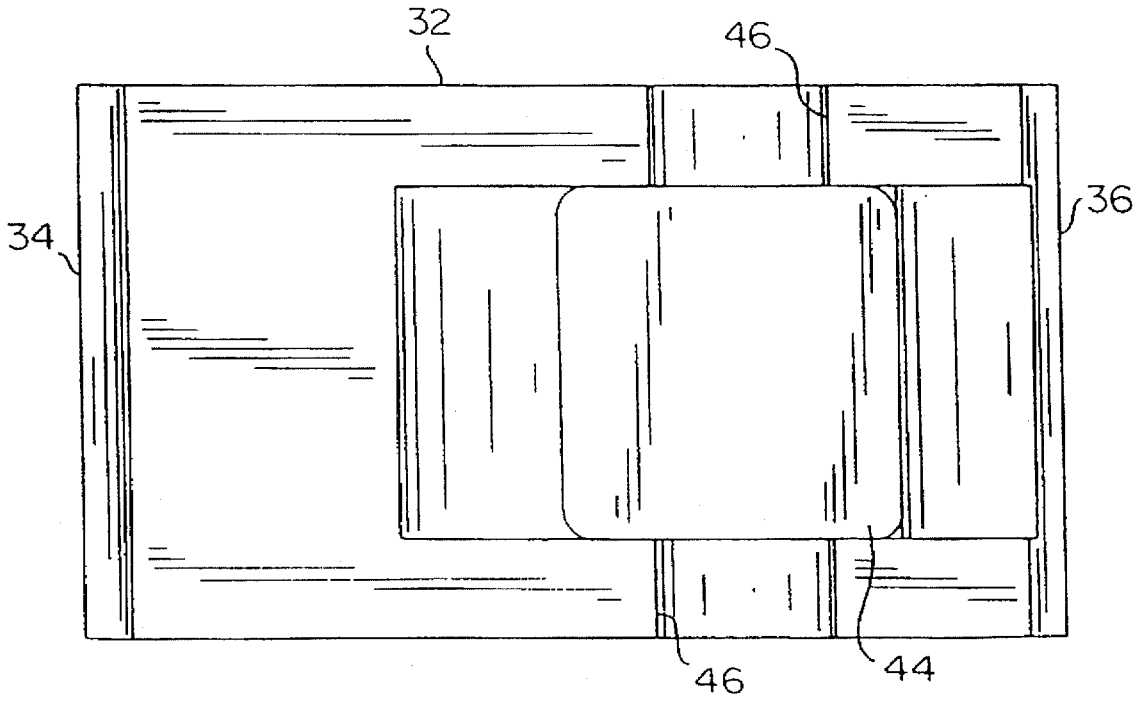
FIG. 11 is a side elevational view of the rotation control link.

Referring now to FIGS. 1–12, the hinge 10 has a main block 12 mounted on a support means 14 such as a cabinet, a wall, a door frame, etc. which supports the hinged door or panel. The main block 12 has a front 16, a back 18, an upper wall 20 and a lower wall 22. The cross-sectional area of the main block 12 forms a trapezoid. The main block 12 may be formed from a single block of material or may be formed of several components which are assembled. It is preferred that the main block be formed from metal such as high strength aircraft aluminum.

An extender link 24 has a first end 26 and an opposite second end 28. The first end 26 of the extender link 24 is pivotally connected to a first pivot pin 30 which extends between the upper wall 20 and the lower wall 22 of the main block 12. The first pivot pin 30 is disposed in a bore through the height of first end 26 of the extender link 24. A first set of diametrically-opposed bores are formed in the upper wall 20 and the lower wall 22 to receive the first pivot pin 30. The first set of bores may extend completely through the upper wall 20 and the lower wall 22, or the first set of bores may extend only partially through the respective upper wall 20 and the lower wall 22. In the latter embodiment, the first pivot pin 30 is captured in the diametrically-opposed first set of bores. The extender link 24 preferably is a single block having chamfered or rounded ends. The upper and lower edges of the extender link 24 are angularly truncated toward the second end 28 at an angle of approximately 37° so that the second end 28 has a height less than the height of the first end 26. The truncated portion is nearer to the second end 28 than to the first end 26. The second end 28 has a bore therethrough to receive a second pivot pin 31 as will be described. The extender link 24 is disposed such that the second end 28 extends outwardly from the main block 12 toward the door or panel 52.

A rotation control link 32 has a first end 34 and an opposite second end 36. Each end has a respective bore formed therethrough in the height of the rotation control link 32. A third pivot pin 38 is disposed in the bore in the first end 34. The third pivot pin 38 extends into diametrically-opposed second set of bores formed in the upper wall 20 and the lower wall 22 of the main block 12. The second set of bores may extend completely through the upper wall 20 and the lower wall 22, or the second set of bores may extend only partially through the upper wall 20 and the lower wall 22. In the latter embodiment, the third pivot pin 38 is captured in the diametrically-opposed second set of bores. The rotation control link 32 preferably is formed from a single block. The rotation control link 32 is disposed such that the second end 36 extends outwardly from the main block 12 toward the door or panel 52. At approximately one-third of the distance between the first end 34 and the second end 36, the first side 40 of the rotation control link 32 is offset at an angle of approximately 45° away from the second side 42 of the rotation control link 32. At approximately two-fifths of the distance between the first end 34 and the second end 36, the first side 40 of the rotation control link is angled at approximately 45° to a plane substantially parallel to the plane of the initial one-third of the first side 40. At approximately one-third of the distance from the first end 34, a cavity 44 is formed in the second side 42 of the rotation control link 32. The edge of the cavity 44 nearer the first end 34 is angled at approximately 37° toward the first side 40 of the rotation control link 32. The cavity 44 is arcuate and the opposite edge of the cavity 44 is near the second end 36 of the rotation control link 32. The cavity 44 does not extend the full height of the rotation control link 32 and the top and bottom of the cavity is contained within upper and lower edges of the rotation control link 32. A notch 46 is formed in the upper and lower edges of the rotation control link 32, nearer to the second end 36 thereof. The notch 46 communicates with the cavity 44.

An upper plate 48 and a lower plate 50 are mounted parallel to one another on the door or panel 52. Each plate 48, 50 has a respective first end 54, 56 which is disposed near the rear vertical edge of the door or panel 52 such that the plates 48, 50 are substantially perpendicular to the rear vertical edge. The first end 54, 56 of each plate 48, 50 extends outwardly as a flange means, from the door or panel 52 toward the support means 14. Each plate 48, 50 further has an opposite end 58, 60. The upper plate 48 and the lower plate 50 may be formed from two or more separate components and may be joined together or may be formed from a single block of material.

The second end 28 of the extender link is pivotally connected between the upper plate 48 and the lower plate 50 by the second pivot pin 31 received in a diametrically-opposed third set of bores in the upper plate 48 and the lower plate 50. The second end 36 of the rotation control link is pivotally connected between the upper plate 48 and the lower plate 50 by the fourth pivot pin 39 received in a diametrically-opposed fourth set of bores in the upper plate 48 and the lower plate 50.

The first end 26 of the extender link 24, the first pivot pin 30 and the corresponding first set of bores in the main block 12 are disposed near the back 18 of the main block 12 and proximal to the support means 14. The first end 34 of the rotation control link 32, the third pivot pin 38, and the corresponding second set of bores in the main block 12 are disposed near the front 16 of the main block 12 and distal from the support means 14. The second end 28 of the extender link 24, the second pivot pin 31 and the corresponding third set of bores in the plates 48, 50 are disposed proximal to the rear vertical edge of the door or panel 52 and distal from the door or panel 52. The second end 36 of the rotation control link 32, the fourth pivot pin 39 and the corresponding fourth set of bores in the plates 48, 50 are disposed distal from the rear vertical edge of the door or panel and proximal to the door or panel 52. The significance of the disposition of the pivot axes of the links will be evident as the operation of the hinge is described so that proper leverage of the links open and close the door or panel 52.

When the door or panel 52 is in the fully closed position such that the door or panel 52 is substantially parallel and adjacent to the support means 14, the main block 12 is received beneath the upper plate 48, thereby substantially supporting the door or panel 52 and bearing most of the weight of the door or panel 52. The extender link 24 and the rotation control link 32 are separated from one another and are disposed approximately parallel to the support means 14. In a preferred embodiment, the upper plate 48 and the lower plate 50 are approximately of equal length and each has a respective recessed portion 62, 64 formed therein such that respective recessed portions 62, 64 are facing one another. The plates 48, 50 with the recessed portions 62, 64 are spaced apart to snugly receive therebetween the main block 12. In this embodiment, the upper wall 20 of the main block 12 is substantially in contact with the recessed portion 62 of the upper plate 48 and the lower wall 22 of the main block 12 is substantially in contact with the recessed portion 64 of the lower plate 50. Alternately, the lower plate 50 is shorter than the upper plate 48 and does not substantially contact the lower wall 22 of the main block 22. In a further embodiment, the plates 48, 50 are not recessed but are spaced apart a distance to receive the main body 12. The recessed plates provide more positive engagement and improved stability to the door and hinge.

As the door or panel 52 is opened, the rotation control link 32 begins to pivot about the third pivot pin 38 and the fourth pivot pin 39, and the rear vertical edge 66 of the door or panel 52 moves away from the support means 14. The seal between the rear edge 66 of the door or panel 52 and the support means 14 is also opened by this movement. Simultaneously, the extender link 24 begins to pivot about the first pivot pin 30, and the second pivot pin 32 assisting in the pivotal movement of the door or panel 52. As the door or panel 52 pivots away from the support means 14, the separation between the extender link 24 and the rotation control link 32 diminishes. This relative movement is due to the disposition of the pivot axes of the links. The second end 28 of the extender link 24 enters the cavity 44 in the rotation control link 32 and the truncated portions of the extender link 24 are disposed between the upper and lower edges of the rotation control link 32 above and below the cavity 44. When the door or panel 52 is fully opened, the second end 28 of the extender link 24 is completely within the cavity 44 and the second pivot pin 31 is disposed in the notch 46 in the rotation control link 32. The edge of the cavity 44 angled at approximately 37° is in direct contact with the side of the extender link 24 facing the rotation control link 32. The approximately 37° angled truncated portion of the extender link 24 is in direct contact with the second side 42 of the rotation control link 32 above and below the cavity 44. In this manner, the extender link 24 and the rotation control link 32 are interlocked with the door or panel 52 in the fully opened position. This interlocked structure provides a continuous structural support from deep within the main block 12 to deep within the space between the upper plate 48 and the lower plate 50 and substantially supports the door or panel 52 in the fully opened position. In the fully opened position of the door or panel 52, at least one-half of the length of the extender link 24 is supported between the upper wall 20 and the lower wall 22 of the main block 12 to decrease the stress applied to the extender link 24.

It is preferred that the outer surfaces of all components of the hinge 10 be anodized with a Teflon® impregnated coating for maximum reduction of friction.

During the opening and closing of the door or panel 52, the movement of the rear vertical edge 66 of the door or panel 52 approximately defines a hyperbola. The rear vertical edge 66 of the door 52 is adjacent to the support means 14 when the door or panel 52 is fully closed. As the door or panel 52 is opened, the rear vertical edge 66 moves outwardly from the support means 14 towards the opposite edge of the door or panel 52. As the door or panel 52 continues to move toward the fully opened position, the rear vertical edge of the door or panel 52 reaches an apex at a maximum distance from the support means 14 and then moves back toward the support means 14. In the fully opened position, the rear vertical edge 66 of the door or panel 52 is disposed near the main block 12. In this manner, the rear vertical edge 66 of the door or panel 52 has zero closing, i.e., it does not move beyond the zero point of the closed position. The edge of the door or panel 52 remains in front of the face line of the structure. This feature is very important for a cabinet or display case which is very close to a perpendicular wall and there is a need to fully open the door on the structure means (e.g., cabinet or display case) to have complete access within the cabinet or display case. Without the zero closing, the door or panel 52 would contact the perpendicular wall and would limit access. The other alternative, using a standard hinge, would be to make the cabinet or display case smaller to use a door or panel without zero closing. This is inefficient and wasteful of valuable space.

The above description describes a hinge 10 used with a door or panel 52, whereas in practical applications, two hinges or more are used to provide stability to the door or panel 52. The hinges 10 would be mounted at least at the top and bottom of the door or panel 52 and would be identical.

Figure 12:
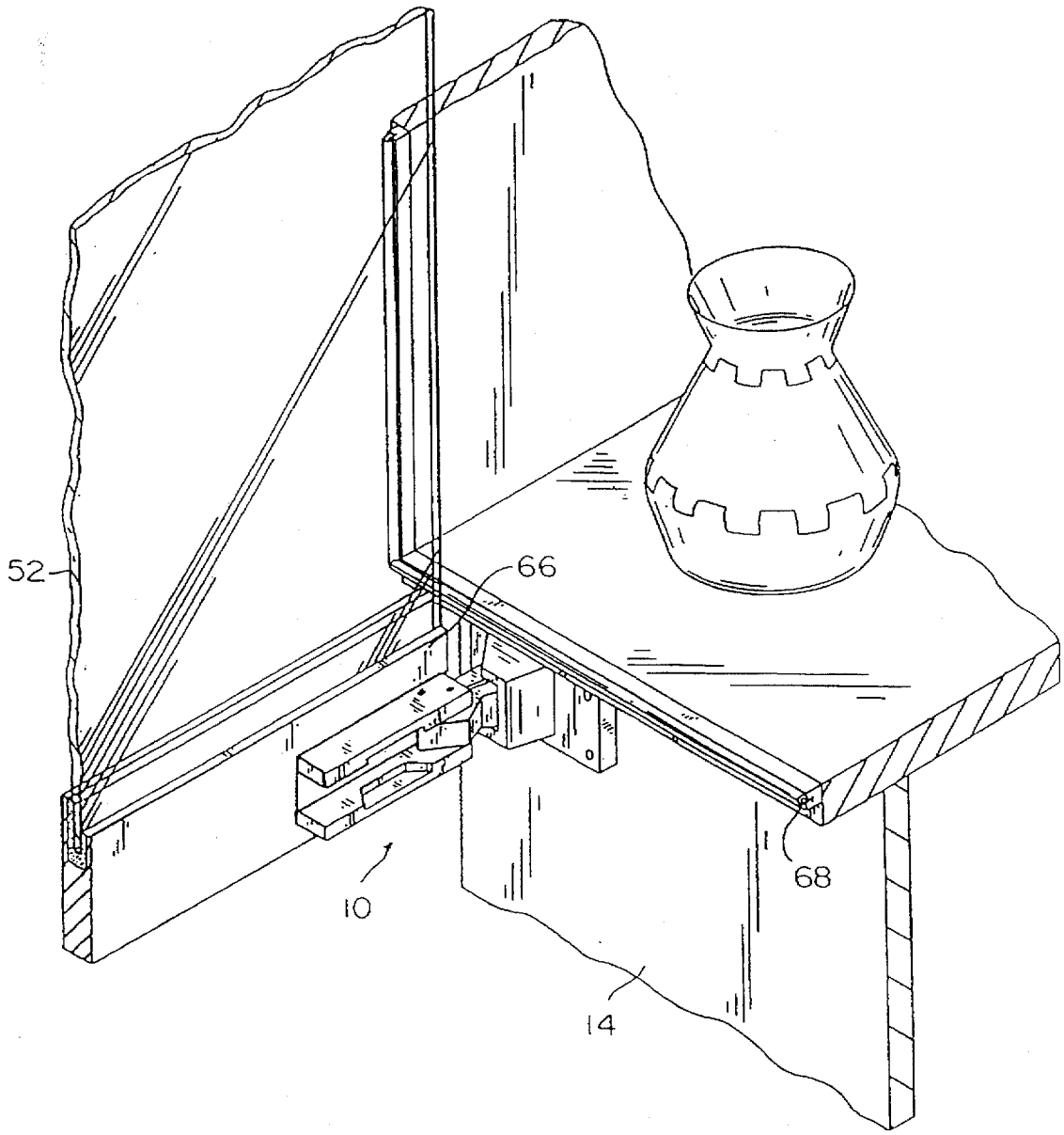
FIG. 12 is a perspective view of the hinge of the present invention used on the display door in a museum.
Figure 13:
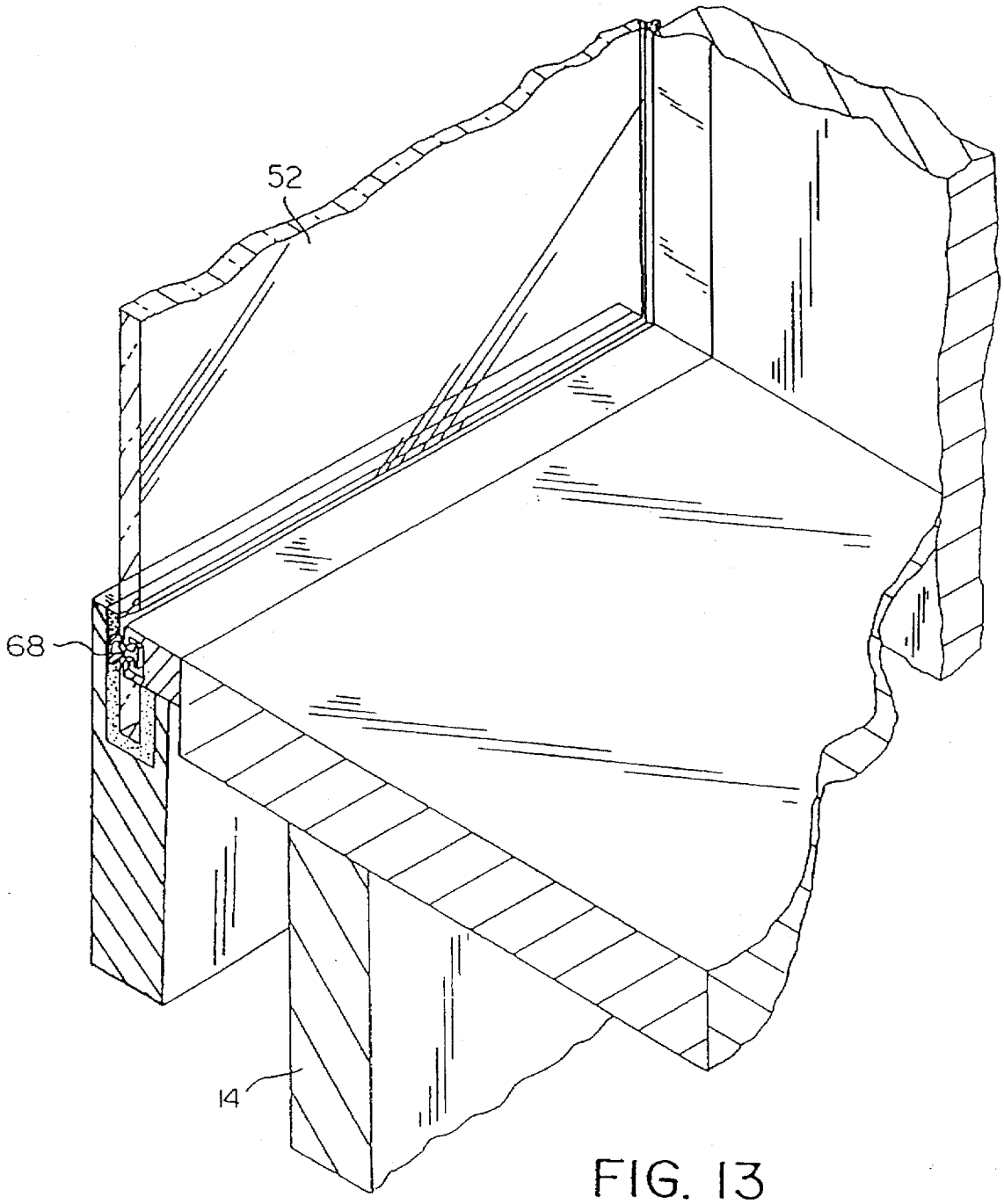
FIG. 13 is a perspective view of a door hinged with the present invention with a resilient seal formed by compression between the door and the frame.
Figure 13A:
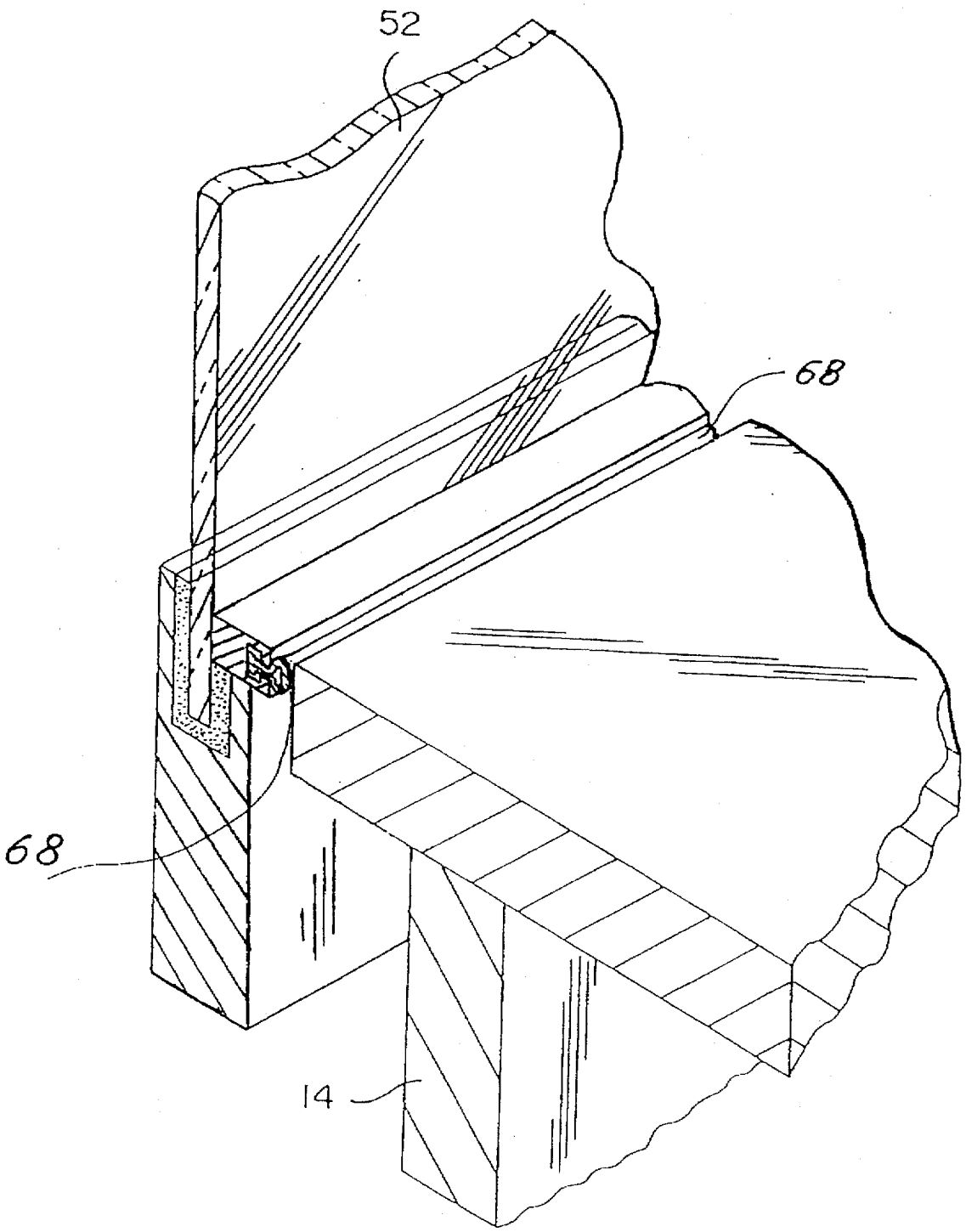
FIG. 13A is a partial perspective view of FIG. 13 showing the resilient seal attached to the door.
Figure 14:
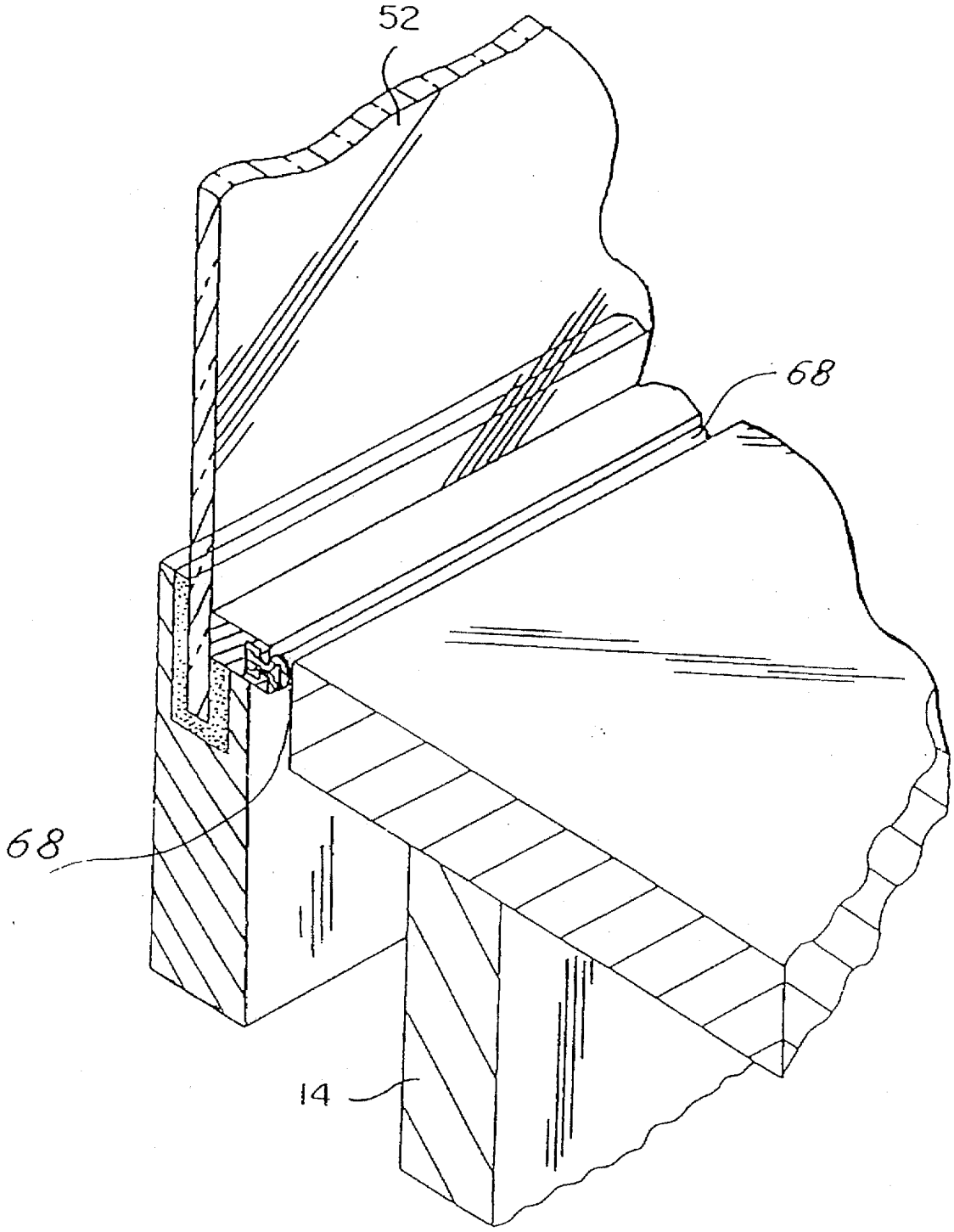
FIG. 14 is a perspective view of a door hinged with the present invention showing release of compression between the door and the frame as the hinge is pivoted to an opened position.
Figure 15:
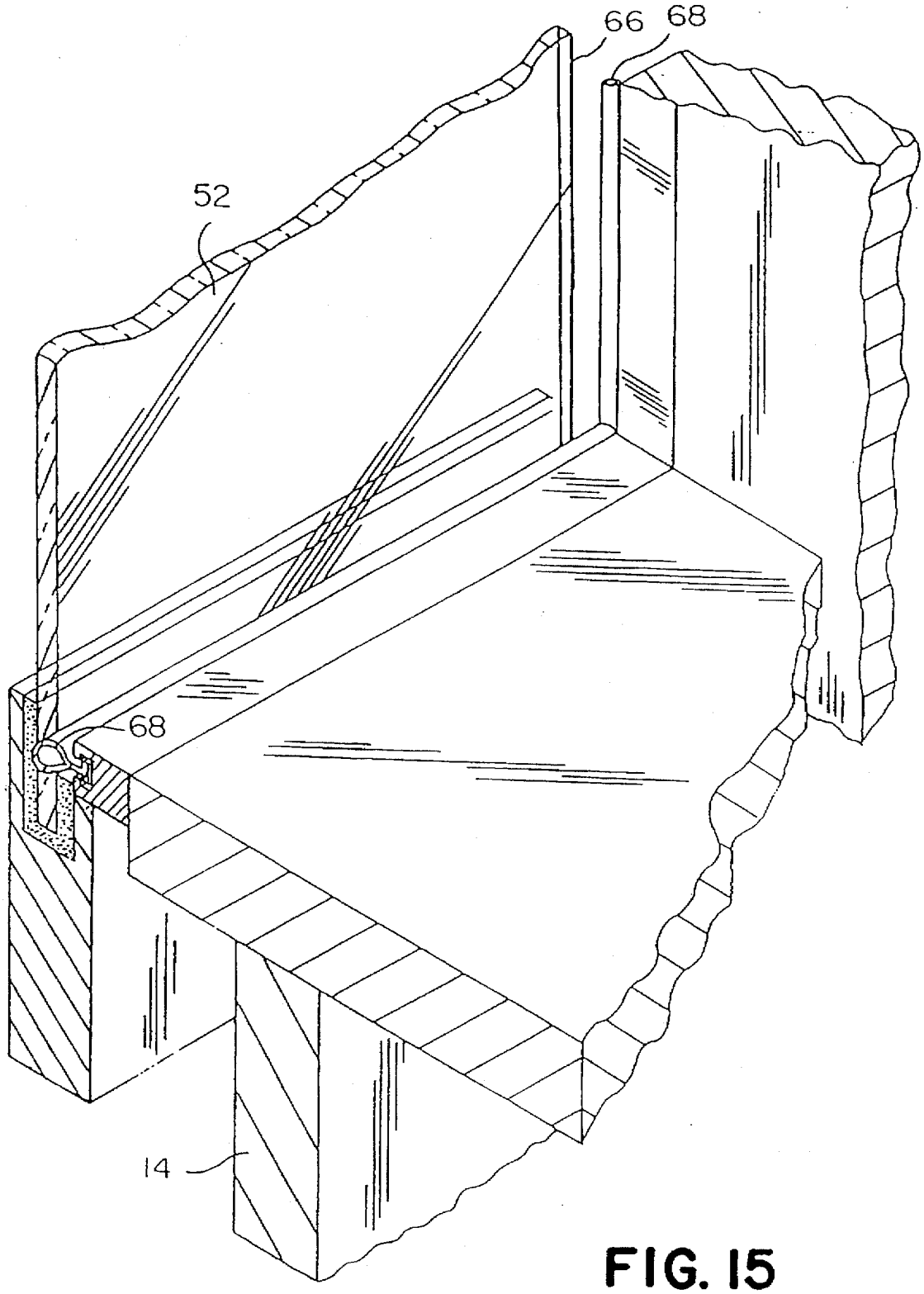

A further feature of the hinge of the present invention is the sealing of the door or panel 52 against a sealant means 68. A compressible sealant means 68 such as tube, a resilient strip, an O-ring, a flexible channel, etc. is connected to the support means or structure 14 (FIGS. 12–14). The structure 14 may be a cabinet, display case, frame, or other support against which the door or panel 52 is closed. Alternately, the sealant means 66 may be connected to the door or panel 52 instead of being connected to the structure 14 (FIG. 13A). When the door or panel 52 is in the closed position, the door or panel 52 is in direct contact with and applying pressure against the sealant means 68. Preferably, the sealant means 68 is disposed around the perimeter of the door or panel 52 to provide a continuous and complete seal between the door or panel 52 and the structure 14. As the door or panel 52 is opened, and as described above, the entire door or panel 52 moves away from the sealant means 68 about the entire perimeter. The movement of the door or panel 52 of the present invention differs from the movement of the conventional door in that the initial movement of the edge of the door is away from the support means 14 followed by the hyperbolic movement rather than a simple arcuate pivot. Thus, in the present invention, the entire perimeter of the door or panel 52 is initially moved outwardly from the support means 14 and then rotated. As a result, the contact between the perimeter of the door or panel 52 and the sealant means 68 is released almost simultaneously along the entire range of contact. In a similar manner, when the door or panel 52 is moved to the closed position, approximately the entire perimeter of the door or panel 52 is brought into contact with the sealant means 68 at the same time and, in the fully closed position, the sealant means 68 is compressed between the door or panel 52 and the structure 14. Thus, the sealant means 68 does not experience shear forces in either the opening or closing process. The absence of shear on the sealant means 68 extends the life of the sealant means 68, reduces maintenance and increase reliability. This is very important for doors on display cabinets in museums and similar locations where it is important to maintain a dustfree, humidity controlled atmosphere within the closed cabinet. The movement of the door or panel of the present invention also provides a means of sealing the vertical edges of two adjoining doors or panels 52. The sealant means 68 is disposed between the respective vertical edges of the adjoining doors or panels 52 being mounted on either or on both doors. The doors may be hinged edge to hinged edge, opposite edge to opposite edge or hinged edge to opposite edge of the respective doors. When both doors are in the fully closed positions, the vertical edges of the respective doors are butted against the sealant means 68 effectively sealing the space between the doors. As either door having the hinge 10 of the present invention is opened, the vertical edge of the door moves outwardly from the support means 14 to which the hinge 10 is mounted, the outward movement defining a hyperbola such that the abutting edge of the door being moved is cleanly separated from the edge of the stationary door and the seal is broken. When the door is closed, the reverse movement occurs and a firm seal is formed.

A further feature of the hinge of the present invention is to provide a fully concealed hinge. The hinge is located between the closed door and the supporting structure and is not visible. The present invention addresses the aesthetics in architectural design as well as the issue of seal compression.

In addition, the hinge of the present invention is useful with doors which open to the outside of a structure where a standard hinge is exposed to the elements. The hinge of the present invention is mounted on the inner side of the door and is not exposed to harsh environmental conditions. The operation of a door mounted using the hinge of the present invention, cannot become impaired because the hinge cannot become coated with ice.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A hinge for supporting a heavy door or panel on a support means, the hinge comprising:

a main block mounted on the support means, the main block having a front, a back, an upper wall and an opposite lower wall;

an extender link having a first end pivotally connected between the upper wall and the lower wall of the main block and a second end extending outwardly from the main block;

a rotation control link having a first end pivotally connected between the upper wall and the lower wall of the main block and a second end extending outwardly from the main block;

an upper plate and a lower plate mounted parallel to one another on the door or panel, each parallel plate having a first end near a rear vertical edge of the door or panel, the respective second ends of each link being pivotally connected to the respective first ends of the parallel plates;

wherein, when the door or panel is pivotally moved to a closed position substantially parallel and adjacent to the support means, the main block is received beneath the upper plate and above the lower plate, thereby substantially supporting the door or panel; and wherein, when the door or panel is pivotally moved to a fully open position, the door or panel and the parallel plates mounted thereon are approximately perpendicular to the support means, the door or panel being substantially supported by the interlocked extender link and the rotation control link.

2. The hinge of claim 1, further comprising the first end of the extender link being pivotally connected near the back of the main block proximal to the support means, the first end of the rotation control link being pivotally connected near the front of the main block distal from the support means, the second end of the extender link being pivotally connected proximal to the rear vertical edge of the door or panel and distal from the door or panel, the second end of the rotation control link being pivotally connected distal from the rear vertical edge of the door or panel and proximal to the door or panel, wherein, when the door or panel is closed, the links are separated and when the door is opened, the links are in contact with one another, cooperating and forming a support between the main block and the parallel plates on the door or panel.

3. The hinge of claim 1, further comprising each parallel plate having a recessed portion formed therein, wherein, when the door or panel is moved to the closed position, the upper wall of the main block is snugly received in the recessed portion of the upper plate and the lower wall of the main block is snugly received in the recessed portion of the lower plate.

4. The hinge of claim 1, wherein the cross-sectional area of the main block between the front, back, upper wall and lower wall defines a trapezoid.

5. The hinge of claim 1, wherein the rotation control link has a cavity formed therein, the second end of the extender link being received therein when the door or panel is in the fully opened position.

6. The hinge of claim 1, wherein the extender link has a length, at least one-half of said length being supported between the upper wall and the lower wall of the main block when the door or panel is in the opened position.

7. A hinge for supporting a door or panel on a support means, the hinge comprising:

a main block mounted on the support means;

an upper plate and a lower plate mounted parallel to one another on the door or panel near a rear vertical edge of the door or panel, the main block being received between the upper plate and the lower plate;

an extender link having a first end pivotally connected to the main block and a second end pivotally connected between the upper plate and the lower plate;

a rotation control link having a first end pivotally connected to the main block and a second end pivotally connected between the upper plate and the lower plate;

the extender link being interlocked with the rotation control link when the door or panel is pivotally moved to an open position approximately at right angles to the support means;

wherein when the door or panel is pivotally moved between the open and the closed position, the movement of the rear vertical edge of the door or panel approximately defines a hyperbola, the rear vertical edge of the door having zero closing.

8. A hinge for sealing a door or panel to a structure comprising in combination:

a main block mounted on the structure, the main block having a front, a back, an upper wall and an opposite lower wall, an extender link pivotally connected to the main block, a rotation control link pivotally connected to the main block adjacent to the extender link, an upper flange means and a lower flange means mounted on the door or panel, the extender link and the rotation control link being pivotally connected between the upper and lower flange means;

compressible sealant means disposed between the structure and the door or panel;

wherein, when the panel or door is pivotally moved to a closed position substantially parallel and adjacent to the structure, the main block is received beneath the upper flange means and above the lower flange means on the door or panel substantially supporting the door or panel, the compressible sealant means forming a seal between the door or panel and the structure;

wherein, when the door or panel is pivotally moved to a fully opened position, the extender link and the rotation control link are interlocked and substantially support the door or panel, the door or panel being rotated away from the support and opening the seal between the door or panel and structure such that the sealant means is compressed and decompressed without shear.

9. The hinge of claim 8, wherein the door or panel has a perimeter, the sealant means being connected to the structure such that when the door or panel is closed, the sealant means contacts the perimeter of the door or panel forming a uniform and continuous seal thereabout.

10. The hinge of claim 8, wherein the door or panel has a perimeter, the sealant means being connected to the door or panel around the perimeter thereof such that when the door or panel is closed, the sealant means contacts the structure forming a uniform and continuous seal thereabout.

11. The hinge of claim 8, further comprising the extender link having a first end and a second end, the first end pivotally connected near the back of the main block proximal to the structure, the rotation control link having a first end and a second end, the first end being pivotally connected near the front of the main block distal from the structure, the second end of the extender link being pivotally connected proximal to the edge of the door or panel, the second end of the rotation control link being pivotally connected distal from the edge of the door or panel wherein, when the door or panel is closed, the links are separated and when the door is opened, the links are adjacent to one another cooperating and forming the support between the main block and the flange means on the door or panel.

12. The hinge of claim 8, wherein the cross-sectional area of the main block between the front, back, upper wall and lower wall defines a trapezoid.

13. The hinge of claim 8, wherein the rotation control link has a cavity formed therein, the second end of the extender link being received therein when the door or panel is in the fully opened position.

14. A hinge for supporting a heavy door or panel on a support means, the hinge comprising:

a main block mounted on the support means, the main block having a front, a back, an upper wall and an opposite lower wall;

an extender link having a first end pivotally connected between the upper wall and the lower wall of the main block and a second end extending outwardly from the main block;

a rotation control link having a first end pivotally connected between the upper wall and the lower wall of the main block and a second end extending outwardly from the main block;

the rotation control link having a cavity formed therein, the second end of the extender link being received therein when the door or panel is in the fully opened position;

an upper plate and a lower plate mounted parallel to one another on the door or panel, each parallel plate having a first end near a rear vertical edge of the door or panel, the respective second ends of each link being pivotally connected to the respective first ends of the parallel plates;

wherein, when the door or panel is pivotally moved to a closed position substantially parallel and adjacent to the support means, the main block is received beneath the upper plate, thereby substantially supporting the door or panel; and wherein, when the door or panel is pivotally moved to a fully open position, the door or panel and the parallel plates mounted thereon are approximately perpendicular to the support means, the door or panel being substantially supported by the interlocked extender link and the rotation control link.

15. A hinge for supporting a heavy door or panel on a support means, the hinge comprising:

a main block mounted on the support means, the main block having a front, a back, an upper wall and an opposite lower wall;

an extender link having a first end pivotally connected between the upper wall and the lower wall of the main block and a second end extending outwardly from the main block;

the extender link having a length, at least one-half of said length being supported between the upper wall and the lower wall of the main block when the door or panel is in the opened position;

a rotation control link having a first end pivotally connected between the upper wall and the lower wall of the main block and a second end extending outwardly from the main block;

an upper plate and a lower plate mounted parallel to one another on the door or panel, each parallel plate having a first end near a rear vertical edge of the door or panel, the respective second ends of each link being pivotally connected to the respective first ends of the parallel plates;

wherein, when the door or panel is pivotally moved to a closed position substantially parallel and adjacent to the support means, the main block is received beneath the upper plate, thereby substantially supporting the door or panel; and wherein, when the door or panel is pivotally moved to a fully open position, the door or panel and the parallel plates mounted thereon are approximately perpendicular to the support means, the door or panel being substantially supported by the interlocked extender link and the rotation control link.

16. A hinge for sealing a door or panel to a structure comprising in combination:

a main block mounted on the structure, the main block having a front, a back, an upper wall and an opposite lower wall, an extender link pivotally connected to the main block, a rotation control link pivotally connected to the main block adjacent to the extender link, an upper flange means and a lower flange means mounted on the door or panel, the extender link and the rotation control link being pivotally connected between the upper and lower flange means;

the rotation control link having a cavity formed therein, an end of the extender link being received therein when the door or panel is in the fully opened position;

compressible sealant means disposed between the structure and the door or panel;

wherein, when the panel or door is pivotally moved to a closed position substantially parallel and adjacent to the structure, the main block is received beneath the upper flange means on the door or panel substantially supporting the door or panel, the compressible sealant means forming a seal between the door or panel and the structure;

wherein, when the door or panel is pivotally moved to a fully opened position, the extender link and the rotation control link are interlocked and substantially support the door or panel, the door or panel being rotated away from the support and opening the seal between the door or panel and structure such that the sealant means is compressed and decompressed without shear.

17. A hinge for supporting a door or panel on a support means, the hinge comprising:

a main block mounted on the support means;

an upper plate and a lower plate mounted parallel to one another on the door or panel near a rear vertical edge of the door or panel;

an extender link having a first end pivotally connected to the main block and a second end pivotally connected between the upper plate and the lower plate;

a rotation control link having a first end pivotally connected to the main block and a second end pivotally connected between the upper plate and the lower plate, the rotation control link having a cavity formed therein, the second end of the extender link being received therein when the door or panel is in the fully opened position;

the extender link thereby being interlocked with the rotation control link when the door or panel is pivotally moved to an open position approximately at right angles to the support means;

wherein when the door or panel is pivotally moved between the open and the closed position, the movement of the rear vertical edge of the door or panel approximately defines a hyperbola, the rear vertical edge of the door having zero closing.

18. A single hinge for supporting a heavy door or panel on a support means, the hinge comprising:

a unitary main block mounted on the support means, the main block having a front, a back, an upper wall and an opposite lower wall;

an extender link having a first end pivotally connected between the upper wall and the lower wall of the main block and a second end extending outwardly from the main block;

a rotation control link having a first end pivotally connected between the upper wall and the lower wall of the main block and a second end extending outwardly from the main block;

an upper plate and a lower plate mounted parallel to one another on the door or panel, the respective second ends of the extender link and the rotation control link being pivotally connected between the upper plate and the lower plate, and the main block being received between the plates when the door or panel is moved to a closed position.

19. A single hinge for supporting a heavy door or panel on a support means, the hinge comprising:

a unitary main block mounted on the support means, an upper plate and a lower plate mounted parallel to one another on the door or panel, an extender link pivotally connecting the main block to the parallel plates, a rotation control link pivotally connecting the main block to the parallel plates, the extender link being nested within the rotation control link when the door or panel is in the opened position.

* * * * *